US007320310B2

(12) United States Patent
Eisenmenger et al.

(10) Patent No.: US 7,320,310 B2
(45) **Date of Patent: *Jan. 22, 2008**

(54) FUEL INJECTOR PROVIDED WITH PROVIDED WITH A PRESSURE TRANSMITTER CONTROLLED BY A SERVO VALVE

(75) Inventors: Nadja Eisenmenger, Stuttgart (DE); Hans-Christoph Magel, Pfullingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/551,461

(22) PCT Filed: Mar. 4, 2004

(86) PCT No.: PCT/DE2004/000413

§ 371 (c)(1),
(2), (4) Date: Sep. 30, 2005

(87) PCT Pub. No.: WO2004/088122

PCT Pub. Date: Oct. 14, 2004

(65) Prior Publication Data

US 2006/0243252 A1 Nov. 2, 2006

(30) Foreign Application Priority Data

Apr. 2, 2003 (DE) ..... 103 15 014
Jun. 5, 2003 (DE) ..... 103 25 620

(51) Int. Cl.
*F02M 37/04* (2006.01)

(52) U.S. Cl. ..... 123/446; 123/467

(58) Field of Classification Search ..... 123/467, 123/446, 514, 506, 447; 239/88–96
See application file for complete search history.

(56) References Cited

U.S. PATENT DOCUMENTS

| | | | | |
|---|---|---|---|---|
| 4,459,959 | A * | 7/1984 | Terada et al. | 123/446 |
| 5,622,152 | A * | 4/1997 | Ishida | 123/446 |
| 6,427,664 | B1 | 8/2002 | Boecking | |
| 6,634,336 | B1 * | 10/2003 | Kropp | 123/467 |
| 6,644,282 | B2 * | 11/2003 | Schwarz | 123/467 |
| 6,892,703 | B2 * | 5/2005 | Magel | 123/446 |
| 6,915,785 | B2 * | 7/2005 | Eisenmenger et al. | 123/446 |

(Continued)

FOREIGN PATENT DOCUMENTS

| | | |
|---|---|---|
| DE | 199 49 848 A1 | 4/2001 |
| DE | 101 23 914 A1 | 11/2002 |
| DE | 102 18 904 A1 | 12/2002 |
| WO | WO 2004/036027 A1 | 4/2004 |

*Primary Examiner*—Carl S. Miller
(74) *Attorney, Agent, or Firm*—Ronald E. Greigg

(57) ABSTRACT

A fuel injector for injecting fuel into a combustion chamber of an internal combustion engine, including a pressure booster, whose booster piston separates a work chamber, subjected to fuel via a pressure reservoir, from a pressure-relievable differential pressure chamber. A pressure change in the differential pressure chamber is effected via an actuation of a servo valve, which opens or closes a hydraulic connection of the differential pressure chamber to a first low-pressure-side return. The servo valve has a piston guided between a control chamber and a first hydraulic chamber. On this servo valve piston, a hydraulic face that positions the servo valve piston constantly in the opening direction when system pressure is applied and a first sealing seat that closes or opens a low-pressure-side return are embodied.

18 Claims, 4 Drawing Sheets

U.S. PATENT DOCUMENTS

2002/0088435 A1* 7/2002 Kropp et al. ..... 123/446
2004/0025843 A1 2/2004 Magel
2004/0025845 A1 2/2004 Magel
2005/0263133 A1* 12/2005 Magel ..... 123/446

* cited by examiner

FUEL INJECTOR PROVIDED WITH PROVIDED WITH A PRESSURE TRANSMITTER CONTROLLED BY A SERVO VALVE

CROSS-REFERENCE TO RELATED APPLICATIONS

This application is a 35 USC 371 application of PCT/DE 2004/000,413 filed on Mar. 4, 2004.

BACKGROUND OF THE INVENTION

1. Field of the Invention

This invention relates to an improved fuel injection system for injecting fuel into internal combustion engines.

2. Description of the Prior Art

Stroke-controlled injection systems with a high-pressure reservoir (common rail) for introducing fuel into direct-injection internal combustion engines are known. The advantage of these injection systems is that the injection pressure can be adapted over wide ranges to the load and rpm. To reduce emissions and to attain high specific output, a high injection pressure is necessary. The attainable pressure level of high-pressure fuel pumps is limited for reasons of strength, so that to further increase the pressure in fuel injection systems, pressure boosters are used in the fuel injectors.

For introducing fuel into direct-injection internal combustion engines, stroke-controlled injection systems with a high-pressure reservoir (common rail) are used. The advantage of these injection systems is that the injection pressure can be adapted over wide ranges to the load and rpm. To reduce emissions and to attain high specific output, a high injection pressure is necessary. The attainable pressure level of high-pressure fuel pumps is limited for reasons of strength, so that to further increase the pressure in fuel injection systems, pressure boosters are used in the fuel injectors.

German Patent Disclosure DE 101 23 913 discloses a fuel injection system for internal combustion engines, with a fuel injector that can be supplied from a high-pressure fuel source. Connected between the fuel injector and the high-pressure fuel source is a pressure booster device that has a movable pressure booster piston. The pressure booster piston divides a chamber that can be connected to the high-pressure fuel source from a high-pressure chamber that communicates with the fuel injector. By filling a differential pressure chamber of the pressure booster device with fuel, or evacuating the differential pressure chamber of fuel, the fuel pressure in the high-pressure chamber can be varied. The fuel injector has a movable closing piston for opening and closing injection openings. The closing piston protrudes into a closing pressure chamber, so that the closing piston can be subjected to fuel pressure to attain a force acting in the closing direction. The closing pressure chamber and the differential pressure chamber are formed by a common closing pressure differential pressure chamber; all the subsidiary regions in the closing pressure differential pressure chamber communicate with one another permanently for exchanging fuel. A pressure chamber is provided for supplying the injection openings with fuel and subjecting the closing piston to a force acting in the opening direction. A high-pressure chamber communicates with the high-pressure fuel source in such a way that in the high-pressure chamber, aside from pressure fluctuations, at least the fuel pressure of the high-pressure fuel source can always be applied; the pressure chamber and the high-pressure chamber are formed by a common injection chamber. All the subsidiary regions of the injection chamber communicate permanently with one another for exchanging fuel.

German Patent Disclosure DE 102 294 15.1 relates to a device for needle stroke damping in pressure-controlled fuel injectors. A device for injecting fuel into a combustion chamber of an internal combustion engine is disclosed that includes a fuel injector which can be subjected to fuel that is at high pressure via a high-pressure source. The fuel injector is actuated via a metering valve, and an injection valve member is surrounded by a pressure chamber, and the injection valve member can be urged in the closing direction by a closing force. The injection valve member is assigned a damping element, which is movable independently of it and which defines a damping chamber and has at least one overflow conduit for connecting the damping chamber to a further hydraulic chamber. In DE 102 294 15.1, the control of the fuel injector is effected with a 3/2-way valve, and as a result, although an injector that is economical in both cost and installation space can be defined, nevertheless this valve must control a relatively large return quantity of the pressure booster.

Instead of the embodiment of a 3/2-way valve known from DE 102 294 15.1, servo valves may also be used, which in the state of repose of the servo valve are embodied in nonleaking fashion on the guide portion, which is favorable to the efficiency of a fuel injector. A disadvantage, however, is the fact that in the opened state of the servo valve piston of the 3/2-way valve, no pressure face pointing in the opening direction of the piston is subjected to system pressure. As a result, the movement of the servo valve piston in its housing is quite vulnerable to production tolerances. Moreover, a slow opening speed of the servo valve piston cannot be attained, and thus the minimum-quantity capacity of a servo valve configured in this way is limited. In the opened state of the servo valve piston, only an inadequate closing force ensues at a second valve seat embodied on it, and the result can be leaks and increased wear.

SUMMARY OF THE INVENTION

To attain a defined motion of a piston of a servo valve for actuating a fuel injector, a servo valve embodied as a 3/2-way valve is proposed, which has a hydraulically operative face that can be urged in the opening direction and that is constantly subjected to system pressure. The system pressure is equivalent to the pressure level prevailing in the high-pressure reservoir. By this provision, the motion of the servo valve piston can be adjusted without problems by adapting an inlet and outlet throttle on the servo valve. By means of a slowly proceeding opening motion of the servo valve piston, good definition of small preinjection quantities and a nonfluctuating pressure buildup can be assured. Because of the defined opening force, the servo valve proposed according to the invention is not vulnerable to tolerances in terms of the effects of friction, so that a production-dictated deviation in tolerances, with attendant major deviations in injection quantities, can be avoided.

The servo valve proposed according to the invention, embodied as a 3/2-way valve, moreover, in its state of repose, has no leakage flows that occur at a guide portion. This means a considerable improvement in the injector efficiency; because of the small guide lengths thus possible on the servo valve piston, a short structural length of the servo valve can be made possible, which favorably affects the total structural height of a fuel injector with a pressure booster in an injector body, including the servo valve; that is, the space needed for this kind of fuel injector is reduced considerably.

If a sealing seat, embodied on the servo valve piston of the servo valve, is embodied as a flat seat, then advantageously the housing of the servo valve can be embodied as a multi-part housing, making it possible to compensate for an axial offset of components from one another. This capability of compensating for production-dictated component tolerances and the ease of manufacture of the sealing seat assure simple, inexpensive production of the servo valve proposed according to the invention.

BRIEF DESCRIPTION OF THE DRAWINGS

The invention will be described in further detail below, in conjunction with the drawings, in which.

DESCRIPTION OF THE PREFERRED EMBODIMENTS

Figure 1:
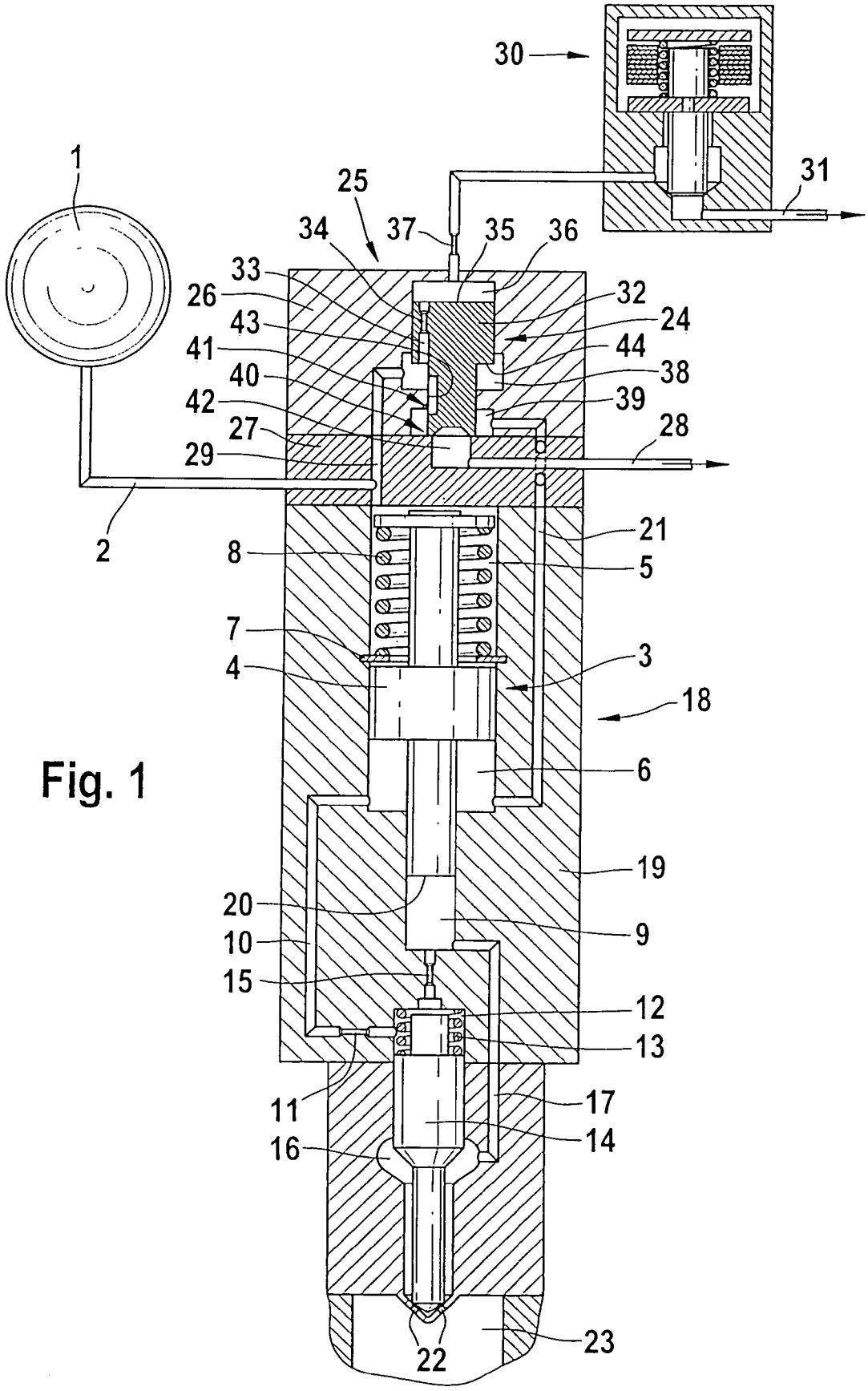
FIG. 1 is a schematic view, in section, of a first embodiment of a servo valve, embodied as a 3/2-way valve, with a servo valve piston free of guidance leakage.

In FIG. 1, a first variant embodiment of a 3/2-way servo valve proposed according to the invention, for triggering a fuel injector that contains a pressure booster, can be seen. Via a pressure source 1 and a high-pressure supply line 2 connected to it, a work chamber 5 of a pressure booster 3 is subjected to fuel that is at high pressure. The work chamber 5 is subjected permanently to the fuel, at high pressure, of the pressure source 1. The pressure booster 3 includes a one-piece booster piston 4, which separates the work chamber 5 from a differential pressure chamber 6. The booster piston 4 is subjected to a restoring spring 8, which is braced on one end on a support disk 7 and on the other on a stop disk mounted on a protrusion of the booster piston 4. The differential pressure chamber 6 booster of pressure booster 3 communicates via an overflow line 10 with a control chamber 12 for an injection valve member 14. A first throttle restriction 11 is received in the overflow line 10 from the differential pressure chamber 6 to the control chamber 12 for the injection valve member 14.

A spring element 13 is received in the control chamber 12 for the injection valve member 14 and acts upon one face end of the needle-like injection valve member 14. The injection valve member 14 includes a pressure step, which is surrounded by a pressure chamber 16. The pressure chamber 16 is subjected to fuel that is at boosted pressure via a pressure chamber inlet 17 that branches off from the compression chamber 9 of the pressure booster 3. From the differential pressure chamber 6 of the pressure booster 3, a diversion line 21 extends into the first housing part 26 of a servo valve housing 25. The end face of the booster piston that acts upon a compression chamber 9 of the pressure booster 3 is identified by reference numeral 20. Because of the pressure step at the injection valve member 14, the injection valve member executes an opening motion when the pressure chamber 16 is acted upon by boosted pressure, so that from the pressure chamber 16, fuel flows along an annular gap to injection openings 22 and reaches a combustion chamber 23 of a self-igniting internal combustion engine.

The control chamber 12 that acts on the injection valve member 14 communicates hydraulically with the compression chamber 9 of the pressure booster 3 via a second throttle restriction 15.

Above the injector body 19 of a fuel injector 18, there is a servo valve housing 25, which receives a servo valve 24. In the embodiment shown in FIG. 1, the servo valve housing 25 is embodied in two parts and includes a first housing part 26 and a second housing part 27. The two-part embodiment of the servo valve housing 25 in the shown in FIG. 1 allows good accessibility for machining the sealing seat and a slide edge, making the servo valve 24 simple and economical to produce.

From the high-pressure supply line 2, by way of which the work chamber 5 of the pressure booster 3 is subjected to fuel that is at high pressure, a supply line 29 branches off into the valve housing 25. The supply line 29 discharges into a first hydraulic chamber 38 of the first housing part 26 of the servo valve housing 25. The first hydraulic chamber 38 surrounds a servo valve piston 32, which includes a through conduit 33. A third throttle restriction 34 is embodied in the through conduit 33 of the servo valve piston 32. Via the through conduit 33 and throttle 34, fuel flows from the first hydraulic chamber 38 into a control chamber 36 of the servo valve 24. A pressure relief of the control chamber 36 is effected upon actuation of a switching valve 30, upon whose opening, control volume from the control chamber 36, via a return that contains an outlet throttle restriction 37 (fourth throttle restriction), communicates with a further low-pressure-side return 31, and fuel can be diverted into this return. The control chamber 36 of the servo valve 24 is defined by an end face 35 on the top side of the servo valve piston 32. This control chamber is located at the head of the servo valve piston 32, opposite an annular face which is operative in the opening direction of the servo valve piston 32 and is acted upon by the pressure prevailing in the first hydraulic chamber 38. Also embodied on the servo valve piston 32 are a first sealing seat 40, in a second hydraulic chamber 39, and a control edge 41. Via the first sealing seat 40, the communication with an outlet control chamber 42, from which a low-pressure-side return 28 branches off, is opened and closed. By means of the control edge 41, which in the embodiment shown in FIG. 1 for the servo valve 24 is embodied as a slide sealing edge 43, the first hydraulic chamber 38, which is at system pressure, is sealed off from the second hydraulic chamber 39 while the servo valve piston 32 is moving in the vertical direction. The two returns 28, 31 on the low-pressure side are if at all possible combined into one return, which discharges into a fuel tank.

Figure 2:
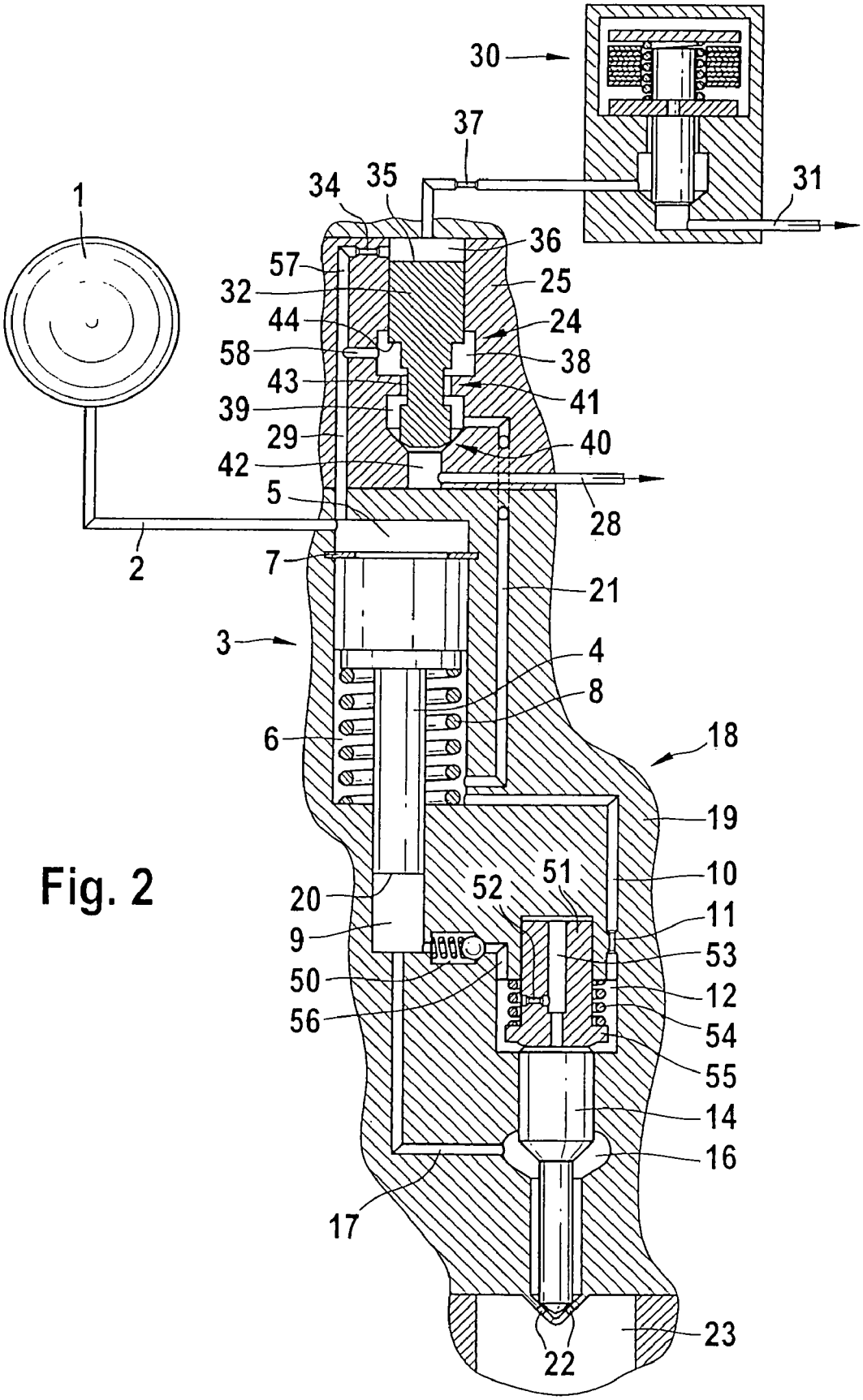
FIG. 2 is a similar view of a further embodiment of a servo valve piston of a 3/2-way servo valve with a first seat embodied as a conical sealing seat and a further seat embodied as a slide seal.

To reinforce the motion of the servo valve piston 32 in the first housing part 26, spring forces—although not shown in FIG. 1—can be brought to bear on the servo valve piston 32. The embodiment of the servo valve 24 shown in FIG. 1 makes an extremely compact construction of the servo valve 24 possible. In the view in FIG. 1, the first sealing seat 40 of the servo valve 24 is embodied as a flat seat, but it could also be embodied as a conical seat (as shown in FIG. 2), a ball seat, or a slide edge. Advantageously, embodying the first sealing seat 40 as a flat seat makes it possible to use a valve body 25 constructed in multiple parts. By means of the first sealing seat 40 embodied as a flat seat, any axial offsets that might occur as a result of production variations can be compensated for without problems. Moreover, by means of the closing force on the flat seat of the first sealing seat 40, brought to bear in the control chamber 36 of the servo valve 24, a very high pressure per unit of surface area and hence good sealing are attained. The first sealing seat 40 may be embodied as either a sealing edge or a sealing face. The sealing force can be adjusted via the pressure face opposite the outlet control chamber 42. As a result, when a sealing face is used, optimal design of the pressure per unit of surface area is possible, as a result of which both adequate tightness on the one hand and only slight wear on the other can be achieved.

FIG. 2 shows a further variant embodiment of the servo valve proposed according to the invention, in which its first sealing seat is embodied as a conical sealing seat. FIG. 2 also shows a fuel injector 18 which contains a pressure booster 3. The work chamber 5 of the pressure booster 3 is supplied with fuel that is at high pressure via a pressure source 1 (common rail) via the high-pressure supply line 2. In a distinction from the embodiment of the pressure booster 3 in the variant embodiment of FIG. 1, the booster piston 4 of the pressure booster 3 as shown in FIG. 2 is embodied in multiple parts. A support disk 7 is let into the injector body 19 of the fuel injector 18 and represents an upper stop face for the upper part of the multi-part booster piston 4. The lower part of the booster piston 4 is acted upon by a restoring spring 8 that is braced on the housing 19; the compression chamber 9 of the pressure booster 3 is defined by way of the end face 20 of the lower part of the booster piston 4. From the differential pressure chamber 6 of the pressure booster 3, an overflow line 10 which contains the first throttle restriction 11 branches off. The overflow line 10 connects the differential pressure chamber 6 of the pressure booster 3 to the control chamber 12 for controlling the reciprocating motion of the injection valve member 14, which is embodied in the form of a needle. The pressure chamber inlet 17 extends from the compression chamber 9 of the pressure booster 3 and discharges into the pressure chamber 16 surrounding the injection valve member 14. The injection valve member 14 includes a pressure step, which has a hydraulically operative face engaged by the fuel pressure prevailing in the pressure chamber 16, which opens the injection valve member 14, so that fuel is injected via injection openings 22, which discharge into the combustion chamber of the self-igniting internal combustion engine and which are opened upon opening of the injection valve member 14.

In a distinction from the variant embodiment shown in FIG. 1, a damping piston 51 is received in the control chamber 12 for the injection valve member 14. The damping piston 51 is penetrated by a vertically extending conduit 53. The conduit 53 communicates hydraulically with the control chamber 12, via a fifth throttle restriction 52 in the wall of the damping piston 51. An annular flange 55 embodied on the damping piston 51 is acted upon by a spring element 54 braced on the housing. From the control chamber 12 for the injection valve member 14, a filling line 56, which contains a refill valve 50 that may be embodied as a check valve, extends to the compression chamber 9 of the pressure booster 3. Via the filling line 56 that contains the refill valve 50, the compression chamber 9 of the pressure booster 3 is refilled with fuel.

In the variant embodiment shown in FIG. 2, the servo valve 24 is received in the valve body 25. The servo valve 24 includes the control chamber 36, which can be pressure-relieved into the second low-pressure-side return 31 via the switching valve 30. An outlet throttle 37 (fourth throttle restriction) is received between the control chamber 36 and the switching valve 30. Opposite the control chamber 36 in the valve body 25 of the servo valve 24 is the first hydraulic chamber 38, which is separated by the control edge 41 from the second hydraulic chamber 39, in this case configured conically. The second hydraulic chamber 39 communicates with the differential pressure chamber 6 of the pressure booster 3. In the variant embodiment of the servo valve 24 in FIG. 2 as well, the control edge 41 is embodied as a slide sealing edge 43. Unlike the variant embodiment of the servo valve 24 shown in FIG. 1, the first sealing seat 40 of the servo valve piston 32 is embodied as a conical seat. When the first sealing seat 40 is closed, the outlet control chamber 42 embodied in the valve body 25 below the servo valve piston 32 is sealed off, so that the first low-pressure-side return 28 is closed.

In a modification of the servo valve piston 32 as shown in FIG. 1, the control chamber 36 and the first hydraulic chamber 38 are subjected to pressure in parallel via the supply line 29, which branches off from the work chamber 5 of the pressure booster 3. Thus via the supply line 29, system pressure prevails both in the first hydraulic chamber 38, which is acted upon via the second supply line portion 58, and in the control chamber 36 of the servo valve 24, via a first supply line portion 57 that includes the third throttle restriction 34. Because of the identity of the pressures in the first hydraulic chamber 38 and the control chamber 36, a guidance leakage along the head of the servo valve piston 32 is precluded. The servo valve piston 32 is guided in high-pressure-proof fashion in the valve body 25. In the position of repose, system pressure prevails inside the guide region of the head of the servo valve piston 32 on both sides, that is, in both the control chamber 36 and the first hydraulic chamber 38, so that no leakage flow to the low-pressure side occurs. The entire region of the servo piston 32, that is, the control chamber 36, the first hydraulic chamber 38, and the second hydraulic chamber 39 along with the control edge 41, is sealed off in a manner free of guidance leakage from the outlet control chamber 42, via the first sealing seat 40 embodied in the second hydraulic chamber 39, and thus also from the first low-pressure-side return 28.

The basic mode of operation of the fuel injector proposed according to the invention, which is triggered via the servo valve 24, will now be described in conjunction with FIG. 1.

The work chamber 5 of the pressure booster 3 communicates constantly with the pressure source 1 and is constantly at the pressure level prevailing there. The compression chamber 9 of the pressure booster 3 communicates constantly via the pressure chamber inlet 17 with the pressure chamber 16, which surrounds the injection valve member 14. Furthermore, the pressure booster 3 includes the differential pressure chamber 6 which to control the pressure booster 3 is either acted upon by system pressure, which is the pressure level prevailing in the pressure source 1, or pressure-relieved into the low-pressure-side return 28 by being disconnected from the system pressure. In the deactivated state, the differential pressure chamber 6 of the pressure booster 3 communicates with the pressure reservoir 1, via the diversion line 21, the opened control edge 41, and the supply line 29, so that the pressures in the work chamber 5 and in the differential pressure chamber 6 of the pressure booster are equivalent to one another, and the booster piston 4 is in equilibrium, and no pressure boosting occurs.

To activate the pressure booster 3, a pressure relief of the differential pressure chamber 6 is effected. To bring about this pressure relief, the switching valve 30 is activated, that is, opened, and the control chamber 36 of the servo valve 24 is relieved into the low-pressure-side return 31, via the outlet throttle restriction 37. Because of the dropping pressure in the control chamber 36, the servo valve piston 32 moves vertically upward, being moved by the pressure force engaging the opening face 44 in the first hydraulic chamber 38. As a result, the first sealing seat 40 is opened, while the control edge 41 is closed, since the slide edge 43 covers the housing edge diametrically opposite it of the valve body 25. Because of the design of the throttle restriction 34 in the through conduit 33 of the servo valve piston 32 and because of the outlet throttle 37, the speed of motion of the servo valve piston 32 in its opening motion can be adjusted arbitrarily. Because of the defined opening face 44 on the underside of the head of the servo valve 24, a pressure force that urges the servo valve piston 32 in the opening direction constantly prevails there. As a result, an exact motion of the servo valve piston 32 and hence its stably remaining at the opening stop in the open state of the servo valve piston 32 can be brought about.

When the servo valve piston 32 is in its opening position, a decoupling of the differential pressure chamber 6 of the pressure booster 3 from the system pressure, that is, the pressure level prevailing in the pressure reservoir 1, takes place. With the control edge 41 closed, an outflow of a control quantity takes place from the differential pressure chamber 6 via the diversion line 21 into the second hydraulic chamber 39 and via the open first sealing seat 40 into the outlet control chamber 42. From there, the fuel quantity diverted from the differential pressure chamber 6 flows into the low-pressure-side return 28.

Because of the inward motion of the end face 20 of the booster piston 4 into the compression chamber 9, a pressure increase takes place in that chamber, so that via the pressure chamber inlet 17, fuel at increased pressure, in accordance with the boosting ratio of the pressure booster 3, flows to the pressure chamber 16 that surrounds the injection valve member 14. Because of the pressure step embodied on the injection valve member 14 in the region of the pressure chamber 16, the injection valve member opens counter to the action of the spring 13, and as a result the injection nozzles 22 on the end of the fuel injector 18 toward the combustion chamber are opened, and fuel can be injected into the combustion chamber 23 of the engine. When the injection valve member 14 is fully opened, the second throttle restriction 15 between the control chamber 12 and the compression chamber 9 of the pressure booster 3 is closed, so that no loss flow occurs during the injection event.

To terminate the injection event, another actuation of the switching valve takes place, moving it into its closing position, so that in the control chamber 36, the system pressure prevailing in the pressure reservoir 1 builds up, via the through conduit 33, the first hydraulic chamber 38, and the supply line 29 discharging into this hydraulic chamber. Because of the pressure force building up in the control chamber 36, the servo valve piston 32 moves downward into its outset position, whereupon the first sealing seat 40 is closed toward the low-pressure-side return 28 and the control edge 41 is opened. Since the end face 35, upon which the pressure prevailing in the control chamber 36 acts, is dimensioned as larger than the opening pressure face 44 in the first hydraulic chamber 38, a defined and rapidly proceeding closing motion of the servo valve piston 32 into its closing position is achieved.

To reinforce the reciprocating motion of the servo valve piston 32, additional springs may also be located in the first housing part 26.

In the differential pressure chamber 6 of the pressure booster and in the control chamber 12, by way of which the injection valve member 14 is controlled, a pressure buildup now takes place, to the pressure level prevailing in the pressure reservoir 1, via the supply line 29, which branches off from the high-pressure supply line 2 of the high-pressure reservoir 1, the opened control edge 41, the second hydraulic chamber 39, and the diversion line 21, which discharges into the differential pressure chamber 6. From there, a pressure buildup takes place via the overflow line 10, which contains the first throttle restriction 11, into the control chamber 12.

Simultaneously, upon the pressure buildup in the differential pressure chamber 6 of the pressure booster, refilling of the compression chamber 9 takes place, via the line, in which the second throttle restriction 15 is embodied, that branches off from the control chamber 12 for actuating the injection valve member 14.

The first sealing seat 40 may be embodied as a flat seat, which makes a high pressure per unit of surface area possible, or a conical seat (as shown in FIG. 2), as a ball seat, or as a slide edge. Via the flat seat shown in FIG. 1 as the first sealing seat 40, any axial offset that may occur for production reasons can be compensated for. By way of the high pressure level prevailing in the control chamber 36, the generation of a sufficient closing force is accomplished, so that a high pressure per unit of surface area occurs at the first sealing seat 40 in its closing position, and good sealing action thus remains assured.

With the variant embodiment shown in FIG. 2, using a damping piston 51 which acts upon the injection valve member 14, a reduction in the opening speed of the needle-like injection valve member 14 can be attained. The damping behavior of the damping piston 51 can be adjusted by way of the dimensioning of the spring element 54 acting upon it and the dimensioning of the throttle element 52 embodied in the wall of the damping piston 51. In the variant embodiment shown in FIG. 2, the refilling of the compression chamber 9 of the pressure booster 3 is effected not via the second throttle restriction 15 as in the variant embodiment of FIG. 1, but rather via a filling line 56, branching off from the control chamber 12 of the injection valve member 14, in which line a refill valve 50 embodied as a check valve is received.

The 3/2-way servo valve 24 proposed by the invention may be employed to control all the pressure boosters 3 that are triggered via a pressure change of their differential pressure chamber 6.

Figure 3:
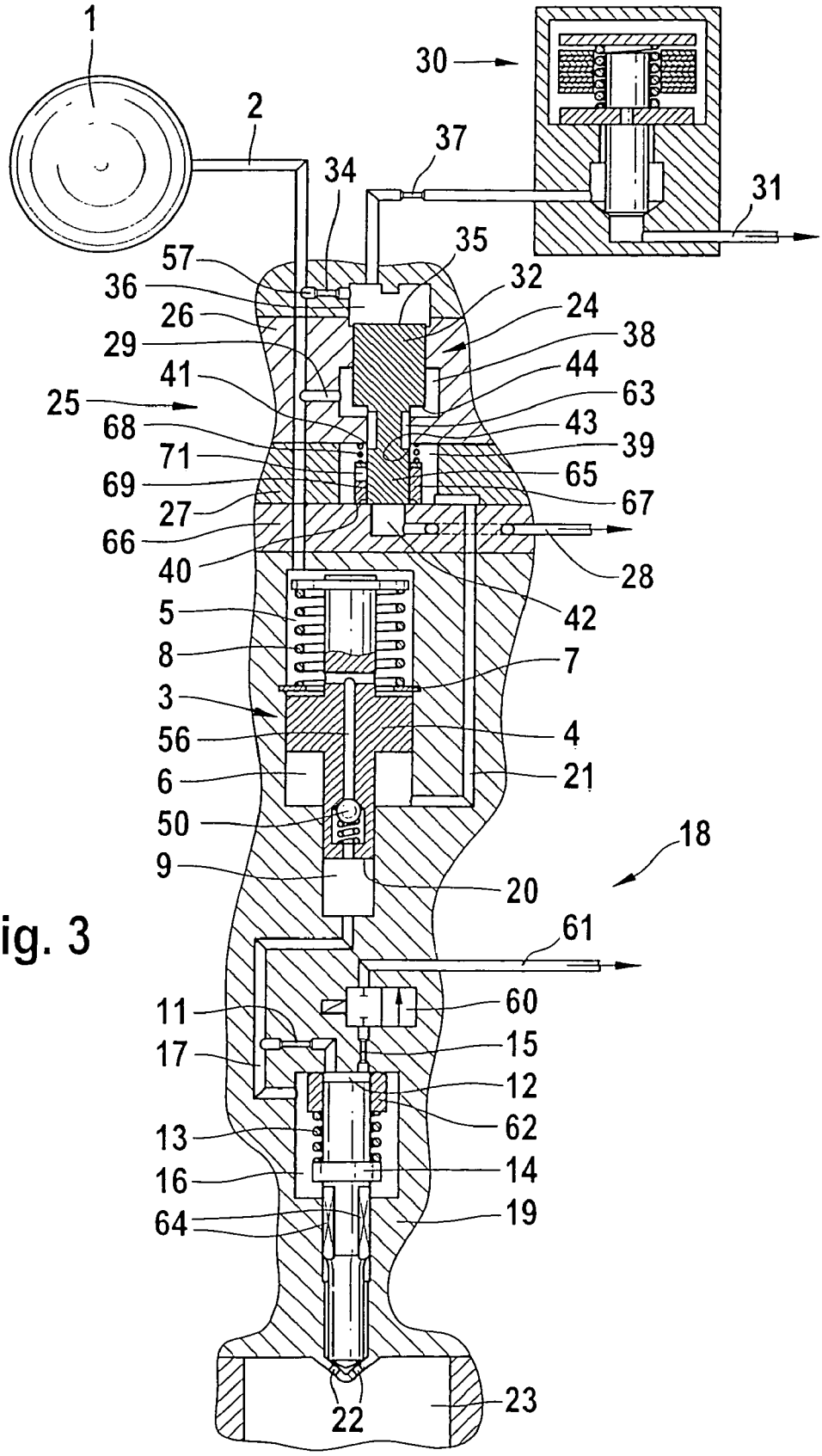
FIG. 3 is a similar view of an embodiment of a 3/2-way servo valve with a servo valve piston on which a control sleeve is received.

From FIG. 3, a variant embodiment can be seen of a 3/2-way servo valve having a servo valve piston on which a control sleeve is received. The pressure booster 3 is supplied with fuel, which is at high pressure, via a high-pressure source 1 via the high-pressure supply line 2. The work chamber 5 of the pressure booster 3 is filled with system pressure via the high-pressure supply line 2, and received in the work chamber is a restoring spring 8, which is braced on one side on a support disk 7 and on the other side is prestressed via a stop face of the booster piston 4 that separates the work chamber 5 from the differential pressure chamber 6. The face end 20 of the booster piston 4 defines the compression chamber 9, from which, upon activation of the pressure booster 3, the pressure chamber 16 is filled with fuel that is at high pressure, via the pressure chamber inlet 17.

The variant embodiment of the fuel injector 18 shown in FIG. 3 includes the control chamber 12, which is defined by a control chamber sleeve 62. The control chamber sleeve 62 is prestressed via the spring 13, and the spring 13 is braced on a collar of the injection valve member 14. Inflow faces 64 are embodied on the injection valve member 14, below the collar, in the form of polished sections. Via these inflow faces 64, the fuel flows from the pressure chamber to injection openings 22, which discharge into the combustion chamber of the self-igniting engine. The control chamber 12 of the fuel injector 18 is subjected to fuel on one side via a first throttle restriction 11, which branches off from the pressure chamber inlet 17; the pressure relief of the control chamber 12 is effected via the second throttle restriction 15, upon actuation of a switching valve 60. If the switching valve 60 is actuated, then a diversion quantity is diverted into an injector return 61 via the second throttle restriction 15.

The pressure booster 3 in the variant embodiment shown in FIG. 3 is actuated via the servo valve 24. The servo valve 24 includes the valve piston 32, which has a servo valve piston portion 65. The servo valve piston 32, 65 is controlled via the subjection of the control chamber 36 to pressure or the pressure relief thereof. On the compression side, the control chamber 36 of the servo valve 24 is subjected to fuel that is at high pressure via the first supply line portion 57, in which the throttle restriction 34 is received. A pressure relief of the control chamber 36 of the servo valve 24 is effected via an actuation of the switching valve 30. Upon its actuation, a diversion volume flows out of the pressure-relieved control chamber 36 of the servo valve 24, via the outlet throttle 37 (fourth throttle restriction) into the return 31 provided on the low-pressure side.

The servo valve 24 includes a housing 25 that includes a plurality of housing parts 26, 27, and 66.

The servo valve piston 32, 65 is surrounded by both the first hydraulic chamber 38 and the second hydraulic chamber 39. The first hydraulic chamber 38 is acted upon by fuel that is at high pressure via the supply line 29 that branches off from the high-pressure supply line 2. The diversion line 21, by way of which a pressure relief of the differential pressure chamber 6 of the pressure booster 3 is effected, discharges into the second hydraulic chamber 39.

The servo valve piston 32 furthermore includes the hydraulic face 44, which is engaged, upon pressure relief of the control chamber 36 of the servo valve 24, by a pressure force that moves the servo valve piston 32 in the opening direction. First recesses 63, which have slide sealing edges 43, are embodied in the servo valve piston portion 65. The slide sealing edges 43 of the first recesses 63 cooperate with a control edge 41 embodied on the second housing part 27. A control sleeve 67 is received on the servo valve piston portion 65 and is prestressed by a control sleeve spring 68, which is braced in turn on the first housing part 26 of the servo valve housing 25. The control sleeve 67 has a recess 71. The first sealing seat 40, in the variant embodiment shown in FIG. 3, is designed as a flat seat and seals off the second hydraulic chamber 39 from the diversion chamber 42 (low-pressure chamber) and the low-pressure-side return 28. The mode of operation of the variant embodiment shown in FIG. 3 of the fuel injector 18 with a pressure booster 3, triggered via the servo valve 24, is as follows:

In the outset state, system pressure prevails in the control chamber 36 of the servo valve 24; this pressure prevails in the control chamber 36 via the third throttle restriction 34 when the switching valve 30 is closed. As a result of the pressure force inside the control chamber 36 of the servo valve piston, which acts on the end face 35 of the servo valve piston 32 and is higher than the opening pressure force that is applied via the face 44 on the servo valve piston 32 that is hydraulically operative in the opening direction, the servo valve piston 32 is moved into its lower position. In this position, the control edge 41 and the slide sealing edge 43 at the servo valve piston portion 65 are open, while conversely the slide seal 69 at the servo valve piston portion 65 is closed. Moreover, the first sealing seat 40 toward the diversion chamber 42 (low-pressure chamber) is in its closed position. Since the second hydraulic chamber 39 is sealed off from the diversion chamber 42 (low-pressure chamber) by the first sealing seat 40, no leakage flow into the low-pressure-side return 28 occurs when the servo valve piston 32, 65 is closed, and as a result, less stringent demands can be made in terms of the guidance leakage (guide length and play) of the control sleeve 67 received on the servo valve piston portion 65.

The first sealing seat 40 may be designed in manifold ways. Besides the embodiment of the first sealing seat 40 as a flat seat as shown in FIG. 3, it may also be embodied as a conical seat, as in the variant embodiment shown in FIG. 2, or as a ball seat. The embodiment of the first sealing seat 40 as a flat seat in conjunction with a multi-part servo valve housing 25 as shown in FIG. 3 is especially advantageous. By means of a multi-part valve body, such as the housing parts 26, 27 and 66, simple manufacture of the valve seat of the first sealing seat 40 can be achieved. As a result of the flat seat shown in FIG. 3, any axial offset of the valve bodies relative to one another that may occur is compensated for. The variant embodiment shown in FIG. 3 furthermore has a strong closing pressure force, exerted by the fuel pressure, prevailing in the control chamber 36, against the first sealing seat 40, and as a result, high pressure per unit of surface area and hence excellent sealing action are established at this sealing seat.

In the state of the repose of the servo valve 24, the differential pressure chamber 6 of the pressure booster 3 is subjected to system pressure via the first recesses 63 on the servo valve piston 65, and the pressure booster 3 remains in communication with the pressure source because of the hydraulic communication between the second hydraulic chamber 39 and the diversion line 21. Because the pressure level in the differential pressure chamber 6 and the work chamber 5 is the same, the pressure booster 3 is deactivated. Upon triggering of the switching valve 30, a pressure relief of the control chamber 36 of the servo valve 24 is effected, causing the servo valve piston 32, 65 to open. Because of the opening force engaging the hydraulic face 44 via the first hydraulic chamber 38, an exact opening of the servo valve piston 32 is effected. Upon opening, the first sealing seat 40 is opened first, and the slide sealing edge 43 is made to coincide with the control edge 41. The control sleeve 67 is now positioned against the third housing part 66 by means of hydraulic pressure force in the second hydraulic chamber 39, and as a result, a high-pressure-proof connection is achieved. Only after that does opening of the slide seal 69 take place, when the servo valve piston portion 65 uncovers the sleeve recess 71. As a result, there is no short-circuit leakage flow from the first hydraulic chamber 38 into the return. The differential pressure chamber 6 of the pressure booster 3 now communicates with the low-pressure-side return 28, via the second hydraulic chamber 39, the slide seal 69, the first sealing seat 40, and the diversion chamber 42 (low-pressure chamber), and the pressure booster 3 is thus activated.

If conversely the switching valve 30 is closed again, then the servo valve piston 32, 65 moves into its outset position because of the hydraulic pressure force in the control chamber 36 that is operative in the closing direction. By means of the hydraulic closing force, an exactly defined closing motion is assured over the entire region of the servo valve piston 32, 65. In addition, to reinforce the closing motion, a spring force may be provided. Upon closure of the servo valve piston 32, 65, a closure of the slide seal 69 occurs first. As a result, the differential pressure chamber 6 of the pressure booster 3 is decoupled from the low-pressure-side return 28. Only after a further closing stroke and hence after a delay $t_1$ does an opening of the control edges 41, 43 take place, so that the pressure booster 3 is fully deactivated. Next, the first sealing seat 40 is closed.

Because of the delay $t_1$ between the closure of the slide seal 69 and the opening of the control edges 41 and the slide sealing edge 43, a pressure cushion is still maintained at the injection valve member 14 for a short time after the main injection, and this pressure cushion can be utilized for a postinjection at high pressure. Given this switching sequence, an overlap of the opening cross sections at the slide seal 69 and the control edges 41, 43 is avoided.

Figure 4:
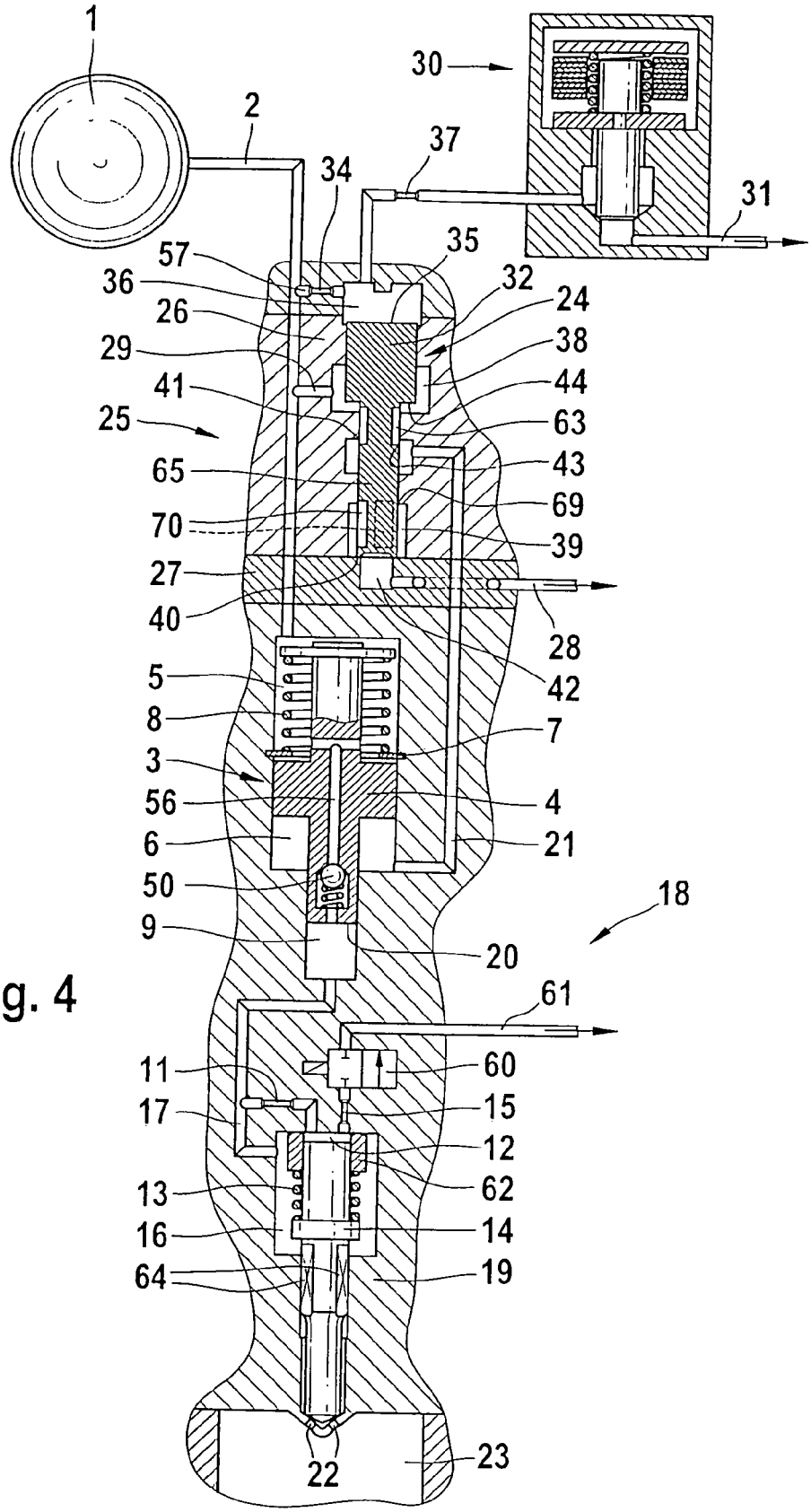
FIG. 4 is an variant embodiment of a 3/2-way servo valve with an elongated servo valve piston.

From FIG. 4, a variant embodiment with an elongated servo valve piston can be seen. Unlike the above-described variant embodiment shown in FIG. 3 for a fuel injector 18 which is triggered via a servo valve 24, here the servo valve piston 32 has a piston portion 65 that is embodied in elongated form. In this variant embodiment, two recesses 70 are embodied on the end of the servo valve piston portion 65 pointing toward the diversion chamber 42 (low-pressure chamber). Two or more recesses 70 may be embodied on the circumference of the servo valve piston portion 65. In this variant embodiment, the slide seal 69 is integrated directly with the first housing part 26 of the servo valve housing 25. In this variant embodiment, the control sleeve 67 shown in FIG. 3 on the servo valve piston portion 65 can be omitted.

The mode of operation of the variant embodiment shown in FIG. 4 is identical to the mode of operation described for the variant embodiment of the fuel injector 18 in FIG. 3.

As shown in FIG. 4, a flat seat is embodied on the end face of the servo valve piston portion 65 that points toward the diversion chamber 42 (low-pressure chamber).

In the variant embodiments shown in FIGS. 1 through 4, with a first sealing seat 40 in the servo valve housing 25, the servo valve 24 may also be embodied as a pure slide-slide valve. Care must be taken to assure a sufficient congruent length at the slide seal 69, to keep the leakage flow in the state of repose of the fuel injector 18 small. Besides the mode of operation described above in the form of a 3/2-way valve, the servo valve 24 may also be embodied as a 4/2-way valve, in which the function of the check valve can be integrated with the slide valve.

The foregoing relates to a preferred exemplary embodiment of the invention, it being understood that other variants and embodiments thereof are possible within the spirit and scope of the invention, the latter being defined by the appended claims.

The invention claimed is:

1. A fuel injector for injecting fuel into a combustion chamber (23) of an internal combustion engine the injector comprising a pressure booster (3) having a booster piston (4) which separates a work chamber (5), permanently subjected to fuel via a pressure source (1, 2), from a pressure-relievable differential pressure chamber (6), and a servo valve (24) actuatable to effect a change in pressure in the differential pressure chamber (6), the servo valve opening or closing a hydraulic connection (21, 39, 42) of the differential pressure chamber (6) to a low-pressure-side return (28), the servo valve (24) having a servo valve piston (32, 65), which is guided between a control chamber (36) and a first hydraulic chamber (38) and on which an operative hydraulic face (44), constantly urged in the opening direction of the servo valve piston (32) by a system pressure, and a first sealing seat (40), which seals off the servo valve (24) from a low-pressure-side return (28) wherein the servo valve piston (32) comprises a first sealing seat (40), which opens or closes the low-pressure-side return (28), and a control edge (41), which separates the first hydraulic chamber (38) from a second hydraulic chamber (39).

2. The fuel injector according to claim 1, wherein the control chamber (36) of the servo valve (24) is subjected to system pressure, via a through conduit (33) extending through the servo valve piston (32), from the first hydraulic chamber (38) into which the supply line (29) discharges.

3. The fuel injector according to claim 2, wherein the through conduit (33) of the servo valve piston (32) includes an integrated throttle restriction (34).

4. The fuel injector according to claim 1, wherein the control chamber (36), via a second supply line portion (57) branching off from the supply line (29), and the first hydraulic chamber (38), via a supply line portion (58) branching off from the supply line (29), are subjected in parallel to system pressure.

5. The fuel injector according to claim 4, wherein the first supply line portion (57) comprises a first throttle restriction (34).

6. The fuel injector according to claim 1, wherein the first sealing seat (40) is embodied as a flat seat or a conical seat and closes an outlet control chamber (42) located on the low-pressure side.

7. The fuel injector according to claim 1, wherein the control edge (41) is embodied as a slide sealing edge (43).

8. The fuel injector according to claim 1, wherein the differential pressure chamber (6), which can be pressure-relieved into the low-pressure-side return (28) via the servo valve (24), is hydraulically coupled with a control chamber (12) for an injection valve member (14), which control chamber receives a damping piston (51), and the damping piston (51) includes a throttle restriction (52) which defines the opening speed of the injection valve member, and the control chamber (12) for actuating the injection valve member (14) communicates via a filling line (56) with either the control chamber (12) or one of the hydraulic chambers (5, 6, 9) of the pressure booster (3).

9. The fuel injector according to claim 1, wherein the actuation of the servo valve (24) is effected via a switching valve (30) that connects the control chamber (36) to a return (31).

10. The fuel injector according to claim 1, wherein the servo valve piston (32) comprises a reduced-diameter servo valve piston portion (65), and a prestressed control sleeve (67) received on the reduced diameter servo piston portion.

11. The fuel injector according to claim 10, wherein the control sleeve (67) together with the servo valve piston portion (65) forms a slide control edge (69).

12. The fuel injector according to claim 11, wherein the slide control edge (69) controls the communication with the low-pressure-side return (28).

13. The fuel injector according to claim 10, wherein the servo valve piston portion (65) of the servo valve piston (32) has first recesses (63), each of which includes a slide sealing edge (43) which cooperates with a control edge (41) embodied toward the servo valve housing.

14. The fuel injector according to claim 10, further comprising a spring element (68) acting on the control sleeve (67), the spring element (68) being braced against a housing part (26) of the servo valve housing (25).

15. The fuel injector according to claim 10, wherein the servo valve piston portion (65) of the servo valve piston (32) comprises first recesses (63) between the first hydraulic chamber (38) and the second hydraulic chamber (39) and second recesses (70), the first recesses (63) and second recesses (70) being a slide seal (69).

16. A fuel injector for injecting fuel into a combustion chamber (23) of an internal combustion engine the injector comprising a pressure booster (3) having a booster piston (4) which separates a work chamber (5), permanently subjected to fuel via a pressure source (1, 2), from a pressure-relievable differential pressure chamber (6), and a servo valve (24) actuatable to effect a change in pressure in the differential pressure chamber (6), the servo valve opening or closing a hydraulic connection (21, 39, 42) of the differential pressure chamber (6) to a low-pressure-side return (28), the servo valve (24) having a servo valve piston (32, 65), which is guided between a control chamber (36) and a first hydraulic chamber (38) and on which an operative hydraulic face (44), constantly urged in the opening direction of the servo valve piston (32) by a system pressure, and a first sealing seat (40), which seals off the servo valve (24) from a low-pressure-side return (28), wherein the control chamber (36) and the first hydraulic chamber (38) are subjected to system pressure via a supply line (29) that originates at the pressure source (1), and the servo valve piston (32) comprises a first sealing seat (40), which opens or closes the low-pressure-side return (28), and a control edge (41), which separates the first hydraulic chamber (38) from a second hydraulic chamber (39).

17. The fuel injector according to claim 16, wherein the first sealing seat (40) is embodied as a flat seat or a conical seat and closes an outlet control chamber (42) located on the low-pressure side.

18. The fuel injector according to claim 16, wherein the control edge (41) is embodied as a slide sealing edge (43).

* * * * *

UNITED STATES PATENT AND TRADEMARK OFFICE

CERTIFICATE OF CORRECTION

PATENT NO. : 7,320,310 B2
APPLICATION NO. : 10/551461
DATED : January 22, 2008
INVENTOR(S) : Nadja Eisenmenger et al.

It is certified that error appears in the above-identified patent and that said Letters Patent is hereby corrected as shown below:

Title page,

Item (54) should read as follows:

(54) FUEL INJECTOR PROVIDED WITH A PRESSURE TRANSMITTER CONTROLLED BY A SERVO VALVE

Signed and Sealed this

Twenty-ninth Day of April, 2008

JON W. DUDAS
*Director of the United States Patent and Trademark Office*

UNITED STATES PATENT AND TRADEMARK OFFICE

CERTIFICATE OF CORRECTION

PATENT NO. : 7,320,310 B2
APPLICATION NO. : 10/551461
DATED : January 22, 2008
INVENTOR(S) : Nadja Eisenmenger et al.

It is certified that error appears in the above-identified patent and that said Letters Patent is hereby corrected as shown below:

Title page,

Item (54) and Column 1, lines 1 and 2, title should read as follows:

FUEL INJECTOR PROVIDED WITH A PRESSURE TRANSMITTER CONTROLLED BY A SERVO VALVE

This certificate supersedes the Certificate of Correction issued April 29, 2008.

Signed and Sealed this

Twentieth Day of May, 2008

JON W. DUDAS
*Director of the United States Patent and Trademark Office*